United States Patent [19]

Swiger

[11] 4,244,155

[45] Jan. 13, 1981

[54] BLOCK INTERLOCKING INSERT

[76] Inventor: Arthur R. Swiger, 137 E. Front St., Adrian, Mich. 49221

[21] Appl. No.: 904,012

[22] Filed: May 8, 1978

Related U.S. Application Data

[63] Continuation of Ser. No. 774,503, Mar. 4, 1977, abandoned.

[51] Int. Cl.[3] ..... E04B 2/16

[52] U.S. Cl. ..... 52/442; 52/427; 52/562; 52/715

[58] Field of Search ..... 52/715, 712, 442, 562, 52/426, 439, 582, 421, 561, 379, 383, 564, 427, 438, 565; 249/218, 219 R

[56] References Cited

U.S. PATENT DOCUMENTS

| | | | |
|---|---|---|---|
| 1,146,223 | 7/1915 | Wiswell | 52/715 |
| 1,564,889 | 12/1925 | Orlopp | 249/218 |
| 1,943,285 | 1/1934 | Boyland | 52/259 |
| 2,261,510 | 11/1941 | Atcheson | 52/715 |

FOREIGN PATENT DOCUMENTS

| | | | |
|---|---|---|---|
| 800990 | 11/1950 | Fed. Rep. of Germany | 52/564 |
| 542369 | 8/1922 | France | 52/715 |
| 579002 | 7/1958 | Italy | 52/562 |

*Primary Examiner*—John E. Murtagh

*Attorney, Agent, or Firm*—William Preston Hickey

[57] ABSTRACT

A bent steel insert is provided with top and bottom pairs of abutments for engaging the inside surfaces of top and bottom rows of concrete blocks to center the rows on top of each other. The preferred embodiment is made of a single strip of steel by: bending it adjacent one end at approximately a 90° angle; by doubling it back upon itself to project to the opposite side of the original plane of the strip; and then bending it back again to the original plane to provide top and bottom abutments at one end. The opposite end of the strip is similarly bent to form abutments which are a mirror a image of those previously described to thereby provide pairs of top and bottom abutments for centering building blocks on top of each other.

7 Claims, 3 Drawing Figures

BLOCK INTERLOCKING INSERT

RELATED APPLICATIONS

The present application is a continuation-in-part application of a co-pending application Ser. No. 774,503, filed Mar. 4, 1977, now abandoned.

BACKGROUND OF THE INVENTION

Building blocks are customarily made with two or more generally uniformly shaped openings extending between their top and bottom surfaces. Concrete block are perhaps the most common and extensively used building block of the day, and these blocks contain two openings of generally square cross section extending between the top and bottom surfaces. These building block are made in molds having a pair of insert for forming the pair of vertically extending openings; and these inserts are slightly tapered so that they can be withdrawn out of the openings after the block is molded. This configuration of block, therefore, has slightly tapered openings, with one end thereof being slightly smaller than is the other end. Although the invention is not so limited, it is hereafter described as having particular advantages for use for this and other types of building blocks which have openings therethrough that are slightly tapered.

In the usual manner of laying building blocks into walls, one row of building block is laid end to end in a straight line over the top of a suitable foundation. Thereafter, mortar is laid on the top surfaces of the first layer of block, and a second layer of block is pushed down on top of the mortar that has been placed on the bottom row of blocks. A straight edge is placed vertically against the side face of the bottom row of blocks, and the top row of blocks is moved laterally so that its front face just engages the straight edge. Thereafter, excess mortar is scraped from the joints between the tiers of blocks. The process of "buttering" the mortar on top of each block and carefully aligning each block is a laborious, time consuming task, which both limits the number of blocks which can be put in place, and makes the process too exacting for most amateurs.

Another problem that is encountered with building blocks is that they presently are held in place only by the mortar in the joints and any movement of the wall opens these concrete mortar joints to allow weather to penetrate into the internal opening and perhaps all of the way through the block wall.

A principle object of the present invention therefore, is the provision of a new and improved type of block aligning insert which will automatically center rows of blocks on top of each other.

Another object of the invention is the provision of a new and improved type of alignment insert which will key the building blocks laterally, so that flexible mortar bonding materials can be used in the joints to accommodate a slight amount of movement of the blocks, and thereby provide a more weather-proof construction.

A further object of the invention is the provision of a new and improved insert of the above described type which is simple in design, rugged in construction, and inexpensive to manufacture; and which will key the individual blocks to an exact, aligning, position with provision for uniform joints therebetween, so that the joint material can be trowled into place after a large number of the blocks have been keyed together.

Further objects and advantages of the present invention will become apparent to those skilled in the art from the following description of several preferred embodiments, described with reference to the accompanying drawings forming a part of this specification.

DESCRIPTION OF THE PREFERRED EMBODIMENTS

Figure 1:
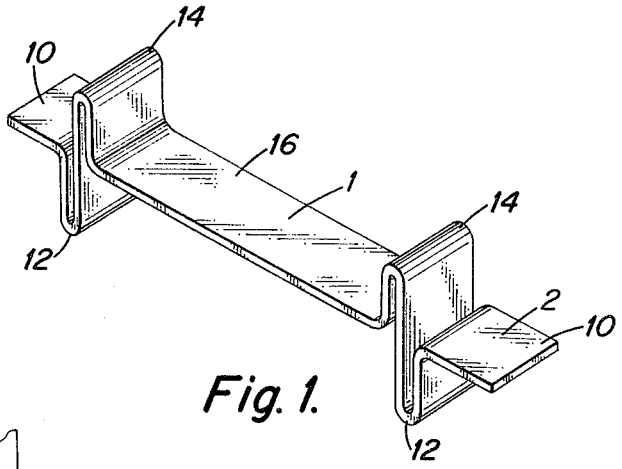
FIG. 1 is an isometric view of a preferred embodiment of the block interlocking insert of the present invention.

The preferred embodiment of block interlocking insert shown in FIG. 1 generally comprises a pair of opposite end metal flanges of tabs 10, a pair of downwardly extending abutments 12, a pair of upstanding abutments 14, and a center spacing section 16. The preferred embodiment shown in FIG. 1 is made from a single piece of strip steel of from $\frac{3}{4}$ to 1 inch wide, and having a thickness of from 26 to 16 gauge. A downwardly extending abutment 12 is made by bending the strip of steel downwardly at right angles to the tab 10, then backwardly to project to the opposite side of the tab 10 to form one of the upwardly extending abutments 14. The strip may extend laterally from the top of the abutment 14, but as shown in the drawing is formed by bending the strip backwardly again to the plane of the tab 10, whereupon it is bent at 90° to form the center spacing section 16. The other one of the pair of abutments 10 is similarly made by bending the metal first upwardly and then downwardly to the opposite side of the center section, then upwardly again to the horizontal tab 10, where is bent at right angles to form the other one of the pair of tabs 10. It will be seen that the opposite abutments are mirror images of each other.

In some instances, the center spacing section 16 may be in any lateral plane from the tip of the abutments 14 down to the tip of the abutments 12 depending upon the amount of flexibility in the abutments that is desired. The embodiment shown is intended for use with concrete blocks having tapered internal cavities so that the outer faces of the abutments 12 are spaced to engage the walls of the large end of the block cavities while the outer faces of the abutment 14 are spaced to engage the walls of the small end of the block cavities. The tabs 10 have a length corresponding to approximately three fourths of the thickness of the walls of the block, and the bent portions forming the abutments are out of engagement so that there is a springing action to the abutments.

Figure 3:
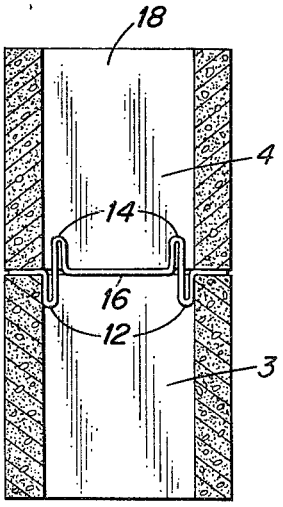
FIG. 3 is a cross sectional view through top and bottom rows of concrete block showing a block interlocking insert in position between the rows.

The insert is used by first laying a row of blocks on a foundation, with either the large end or the small end of the openings of each block facing upwardly. FIG. 3 of the drawing shows the blocks laid with the large end of the cavities 18 facing upwardly, and with the abutments 12 wedged down into the upper end thereof. FIG. 3 shows a second row of blocks pressed down over the abutments 14, so that the abutments 14 engage their inside surfaces to automatically bring the outside faces of both rows of blocks in line. The concrete blocks shown in the drawing have two cavities per block, and therefore, two inserts are used for each block. In some instances, it may not be desired to have a lateral spring action for the abutments, in which case, either the strip steel forming the abutments can be bent back upon itself, or a small piece of filler metal can be inserted between the two legs forming the abutment.

Figure 2:
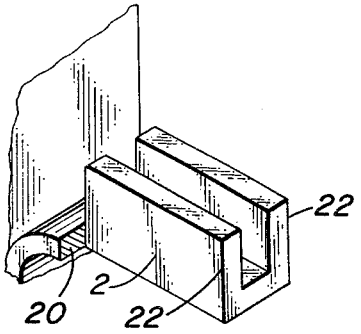
FIG. 2 is an enlarged fragmentary view of the support flange of another embodiment of the present invention.

In those instances where it is desired to have a mortar joint that is thicker than the thickness of the metal from which the insert is made, the tabs 10 can have their side edge portions bent upwardly to form a U-shape as shown in FIG. 2. In order that this can be accomplished the tab will first be sheered inwardly as at 20 by a distance corresponding with the heighth of the mortar joint desired. When the outer edges are bent upwardly into a U-shape, the upstanding legs 22 provide the spacing for the mortar joints.

It will now be seen that a block wall can be made quickly and easily by first laying a row of block on a foundation with all of the blocks having either the small end or the large end of the internal cavities of the block facing upwardly. Assuming that the blocks are laid with the large ends facing upwardly as shown in FIG. 3, one insert is pressed into each cavity with the abutments 12 pressed down into the lower layer of block. Thereafter, the next row of block is positioned with the small end of the cavities downwardly over the top of the abutments 14 to automatically center the upper row of block on the lower row of block with outside faces of the upper row in line with the respective faces of the bottom row. It will further be seen that the tabs 10 automatically space the rows of block by a proper distance apart, and that the inserts automatically key the rows of blocks against lateral movement. When the wall is finished, or a desired amount of wall is laid, mortar can be trowled into the spaces provided by the tabs 10 to complete the wall. It is further contemplated that resilient types of mortar joint material, as for example, a mastic may be used in the spaces between the blocks to accommodate slight settling or shifting as sometimes occurs with block structures. Where a resilient mortar joint material is utilized, a crack should not develop between the blocks since the resilient material will accommodate movement and remain weathertight.

Numerous modifications can be made to the basic structure of block aligning insert above described to accommodate blocks of different types and blocks having different shaped internal cavities. In those instances where the cavities are of uniform cross section, it will be seen that the abutments 14 can be bent outwardly at an angle so that their tips are spaced apart by a distance corresponding to the spacing of the abutments 12. It is also contemplated that the insert can be made of wire instead of strip steel, so that it can be used for walls of extruded brick of the type having cavities of uniform cross section therethrough. In such cases, the end of the wires may be bent upwardly at right angles by a distance corresponding to the desired thickness of mortar joints to serve the same function as shown in FIG. 2.

While the invention has been described in considerable detail, I do not wish to be limited to the particular embodiments shown and described, and it is my intention to cover hereby all novel adaptations, modifications, and arrangements thereof, which come within the practice of those skilled in the art to which the invention relates.

I claim:

1. In a block wall having upper and lower tiers of building block of the type having top and bottom surfaces with walls forming an internal core cavity of generally predetermined width extending therebetween, and with the cavities of the upper and lower tiers being aligned: a long, narrow strip of relatively stiff material having upper and lower surfaces, a width considerably less than that of said predetermined cavity width, and a length greater than said predetermined cavity width positioned between said tiers; said strip having a first upwardly extending U-shaped configuration followed by a first downwardly extending U-shaped configuration positioned longitudinally of each other and lengthwise of said strip, and a second downwardly extending U-shaped configuration and a second upwardly extending U-shaped configuration positioned longitudinally of each other and lengthwise of said strip; said first and second upwardly extendig U-shaped configurations being positioned against the respective opposing vertical core cavity wall surfaces of the upper tier and the first and second downwardly extending U-shaped configurations being positioned against the respective opposing vertical core cavity wall surfaces of the lower tier to key the two tiers together; said strip having end portions positioned between blocks of the upper and lower tiers to hold the blocks of the two tiers apart and provide a space therebetween; and a mortar joint material in said space between said keyed tiers.

2. The device of claim 1 wherein said upwardly extending U-shaped configurations are spaced apart by a distance greater than said downwardly extending U-shaped configurations to accommodate a taper in the cavity sidewalls of the block.

3. The device of claim 1 wherein the U-shaped configurations are constructed and arranged to resiliently abut the internal core cavity wall surfaces of blocks for which they are designed.

4. The device of claim 1 having portions extending outwardly of said abutments, said portions having flanges bent vertically to provide spacing between vertically aligned blocks.

5. The device of claim 4 wherein the portions which extend outwardly of the abutments have opposite side edges bent upwardly or downwardly to provide said flanges.

6. The device of claim 1 wherein the tips of the top and bottom U-shaped configurations are similarly spaced.

7. The block wall of claim 1 wherein the mortar joint material in the space between the keyed tiers is resilient.

* * * * *